United States Patent [19]

Hinton et al.

[11] Patent Number: 4,624,270

[45] Date of Patent: Nov. 25, 1986

[54] HAIR CURLER

[76] Inventors: H. L. Hinton, 31 S. Sheridan Rd., Louisville, Ky. 40220; Albert J. Harden, Jr., 303 Beckley Woods Dr., Louisville, Ky. 40223

[21] Appl. No.: 660,073

[22] Filed: Oct. 12, 1984

[51] Int. Cl.[4] ..... A45D 2/12

[52] U.S. Cl. ..... 132/39; 132/42 A

[58] Field of Search ..... 132/39, 33 R, 40, 41 R, 132/41 A, 41 B, 41 C, 42 R, 42 A, 43 R, 43 A, 44

[56] References Cited

U.S. PATENT DOCUMENTS

| | | | |
|---|---|---|---|
| 687,285 | 11/1901 | Stein | 132/38 R |
| 2,262,081 | 11/1941 | Yven | 132/33 R |
| 2,441,904 | 5/1948 | Rodite | 132/33 R |
| 2,582,550 | 1/1952 | Madore | 132/33 R |
| 2,731,021 | 1/1956 | Oliveros | 132/33 R |
| 2,800,910 | 7/1957 | Seyffarth | 132/31 R |
| 2,829,654 | 4/1958 | Fay | 132/41 R |
| 3,232,300 | 2/1966 | Fisher | 132/39 |
| 3,260,267 | 7/1966 | Rubenstein et al. | 132/40 |
| 4,108,183 | 8/1978 | Mauro | 132/42 A |
| 4,318,419 | 3/1982 | Puckett | 132/40 |

FOREIGN PATENT DOCUMENTS

| | | | |
|---|---|---|---|
| 2715857 | 10/1978 | Fed. Rep. of Germany | 132/40 |

*Primary Examiner*—John J. Wilson
*Attorney, Agent, or Firm*—Jon C. Winger

[57] ABSTRACT

A hair curler including a hollow, cylindrical housing formed of a first and second semi-cylindrical sections hinged together along one of their longitudinal edges. The free longitudinal edge of the first semi-cylindrical section is formed with a thin resilient lip. The second semi-cylindrical section includes two circular end walls. When the two semi-cylindrical sections are closed in registered concavely facing relationship the lip along the free edge of the first semi-cylindrical section overlaps and exerts a force radially toward the free edge of the second semi-cylindrical section, and the opposite ends of the first semi-cylindrical section sealingly abuts the interior surface of the circular end walls of the second semi-cylindrical section. The semi-cylindrical sections are maintained in the closed position by a latch device. Each end wall is formed with a radially extending channel open to the perimeter of the end wall, and open to the exterior surface of the end wall. An elastic band, which is knotted at each end is adapted to be attached to the end walls with its length between the knotted ends extending over the convex surface of the curler housing. A hair winding mandrel is adapted to fit generally longitudinally within the hollow, cylindrical curler housing.

16 Claims, 7 Drawing Figures

HAIR CURLER

BACKGROUND OF THE INVENTION

The present invention relates to hair curlers, and more specifically to hair curlers having a cylindrical hollow housing with hair clamping jaws.

Various hair curlers of this class are shown in the following United States patents. U.S. Pat. No. 687,285 issued on Nov. 26, 1901 to A. Stein, U.S. Pat. No. 2,262,081 issued on Nov. 11, 1941 to E. J. Yven, U.S. Pat. No. 2,441,904 issued on May 18, 1948 to V. J. Rodite, U.S. Pat. No. 2,731,021 issued on Jan. 17, 1956 to G. N. Oliveros, and U.S. Pat. No. 2,800,910 issued on July 30, 1957 to R. Seyffarth.

A problem in the field of treating human hair is treating a new growth of hair next to the scalp without treating previously treated hair near the hair ends. This problem is addressed by the above-mentioned U.S. Pat. No. 2,731,021 issued on Jan. 17, 1956. However, the curler device taught by this patent is relatively complex in construction requiring one using the curler to assemble a number of separate components while performing the job of curling the hair. Thus, the curler of U.S. Pat. No. 2,731,021 is difficult to use aggravating an already frustrating job of hair curling, and adding to the time required to curl hair.

An object of the present invention is to provide a hair curler providing for the treatment of a new growth of hair while without treating previously treated hair which is of relatively simple construction, and therefore much easier to use than other known hair curlers of this type.

A further object of the present invention is to provide a hair curler of the class described which has a housing of one piece construction.

BRIEF DESCRIPTION OF THE DRAWINGS

The foregoing objects and advantages of the present invention will become obvious upon reference to the following discussion in conjunction with the accompanying drawings in which like numerals refer to like parts throughout and wherein.

DETAILED DESCRIPTION OF THE PREFERRED EMBODIMENT

Figure 1:
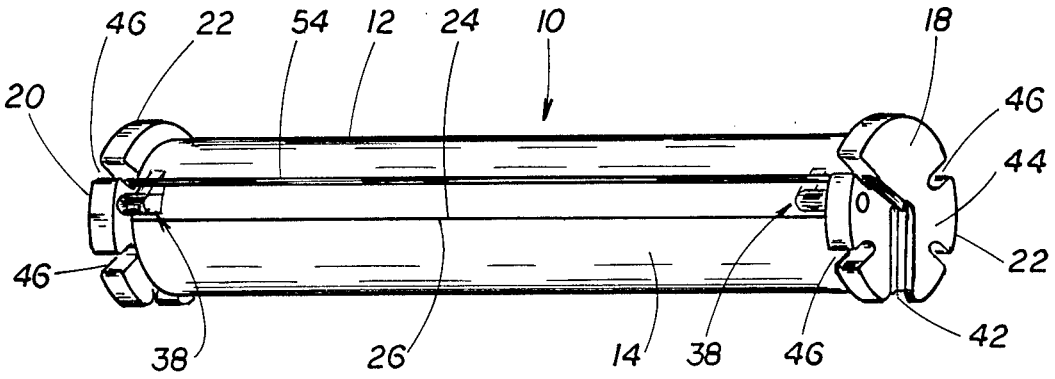
FIG. 1 is a perspective view of the hair curler of the present invention in a closed, in use position.
Figure 2:
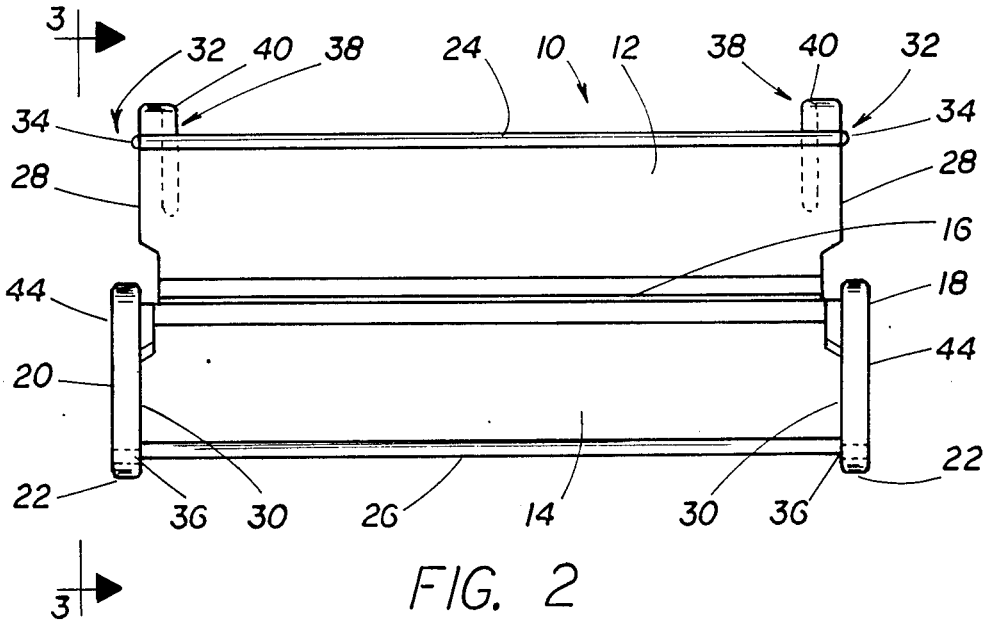
FIG. 2 is a side view o the hair curler of FIG. 1 in an open position.
Figure 3:
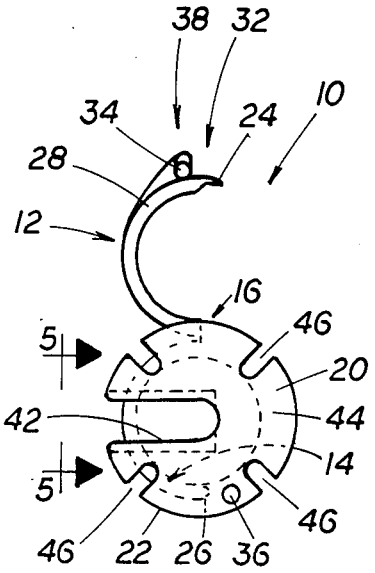
FIG. 3 is an end view of the hair curler as viewed in the direction of Arrows 3—3 in FIG. 2.

With reference to FIGS. 1, 2 and 3, there is shown a hollow, cylindrical hair curler housing, generally denoted as the numeral 10, of the present invention. The hair curler housing 10 includes a first semi-cylindrical housing section 12 and a second semi-cylindrical housing section 14. The first and second semi-cylindrical sections 12 and 14 are hinged together along one of their longitudinal edges by means of a hinge 16 so that they can be selectively pivoted from the closed position, shown in FIG. 1, wherein they are in concavely facing relationship defining the hollow, cylindrical housing 10, and an open position, shown in FIGS. 2 and 3.

The second semi-cylindrical housing section 14 includes two circular end walls 18 and 20 located at the opposite ends of the second semi-cylindrical section 14. The circular end walls 18 and 20 are essentially identical, and are preferably of a larger diameter than that of the semi-cylindrical housing sections 12 and 14 when they are in the closed position so as to provide circumscribing flanges 22.

Figure 4:
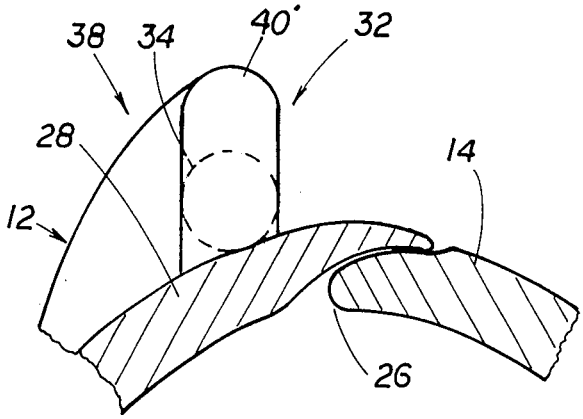
FIG. 4 is an enlarged view of a portion of the hair curler.

Now with reference to FIGS. 1 through 4, the free longitudinal edge of the first semi-cylindrical section 12, i.e. that longitudinal edge opposite the hinged longitudinal edge, is formed with a relatively thin, resilient lip 24. The resilient lip 24 can be integral with the free longitudinal edge of the first semi-cylindrical section 12 and constitute a thinned area of the free longitudinal edge of the first semi-cylindrical section 12. The resilient lip 24 diminishes in thickness toward its distal or free end, and the inner surface of the lip 24 is arcuate having a different curvature than does the outer surface or convex side of the second semi-cylindrical housing section 14. The curvature of the inner surface of the lip 24 can be a curve having a constant radius smaller than the radius of the first semi-cylindrical section 12 with its center or origin displaced from the longitudinal centerline of the first semi-cylindrical housing section 12, or the curve can have a uniformly changing radius which is semi-eliptical or follows a convolute generated from approximately the longitudinal centerline of the first semi-cylindrical section 12. In addition, the radial distance from the longitudinal centerline of the first semi-cylindrical section 12 to the inner surface of the lip 24 proximate the distal end of the lip 24 is slightly less than the radial distance from the longitudinal centerline of the second semi-cylindrical section 14 to the outer surface or convex side of the second semi-cylindrical section 14. The resilient lip 24 is adapted to overlap the free longitudinal edge 26 of the second semi-cylindrical section 14, i.e., that longitudinal edge opposite the hinged longitudinal edge, such that when the two semi-cylindrical sections 12 and 14 are closed in registered concavely facing relationship, the longitudinal lip 24 will overlap the free edge 26 of the second semi-cylindrical section 14 defining a line contact between the inner surface of the lip 24 and convex side of the second semi-cylindrical section 14 proximate the distal end of the lip 24 and proximate the free edge 26 of the second section 14 extending generally longitudinally of the lip 24 and free edge of the second section 14. Thus, there will lie an interference fit created between the lip 24 and convex side of the second section 14 such that the lip 24 will exert a force generally radially thereof toward the convex side of the second semi-cylindrical section 14 near the free longitudinal edge 26 of the second semi-cylindrical section 14 establishing a liquid tight seal therebetween. This relationship is best seen in FIG. 4. Therefore, when the first and second semi-cylindrical sections are closed, hair extending out of the case 10 between the lip 24 and free edge 26 will not be crimped, bent or otherwise distorted. Furthermore, as can be best seen in FIGS. 1 and 2, when the first and second semi-cylindrical sections 12 and 14 are closed in registered concavely facing relationship, the opposite ends 28 of the first semi-cylindrical section 12 sealingly abut the interior surfaces 30 of the circular end walls 18 and 30 of the second semi-cylindrical section 14. Thus, when the first and second semi-cylindrical sections 12 and 14 are in the closed position, they cooperate to define the hollow interior of the curler housing 10 which is tightly sealed.

With reference to FIGS. 1, 3 and 4, the two semi-cylindrical sections 12 and 14 are maintained in the closed position by latch means, generally denoted as the numeral 32. The latch means 32 is illustrated as comprising protuberances 34 at each end 28 of the first semi-cylindrical section 12 and cavities 36 formed in the end walls 18 and 20 of the second semi-cylindrical section 14 open to the interior surfaces 30 of the end walls 18 and 20. The cavities 36 are sized and located to receive the protuberances 34 when the first and second semi-cylindrical sections 12 and 14 are in the closed position, thus, latching them together in their registered concavely facing relationship.

Now referring to FIGS. 1 through 4, the curler housing 10 is also provided with release means, generally denoted as the numeral 38, for conveniently causing the protuberances 34 of the first semi-cylindrical section 12 to release from the cavities 36 in the end walls 18 and 20 of the second semi-cylindrical section 14 so that the curler housing 10 can be opened by moving the semi-cylindrical sections relative to each other about the hinge 16. As shown, the release means 38 includes at least one, but preferably two finger abut flanges 40 projecting from the convex surface of the first semi-cylindrical section 12 near the longitudinal lip 24. As shown, the two finger abutment flanges 40 are spaced apart longitudinally of the first semi-cylindrical section 12, and are located adjacent a different one of the ends 28 of the first semi-cylindrical section 12. Furthermore, as can be best seen in FIGS. 2 and 4, the protuberances 34 of the latch means 32 are integral with the finger abutment flanges 40.

Figure 5:
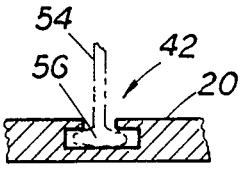
FIG. 5 is an enlarged view of a portion of the hair curler as viewed in the direction of Arrows 5—5 in FIG. 3.

Referring now to FIGS. 1, 3 and 5, the end walls 18 and 20 of the second semi-cylindrical section 14 are each formed with a generally radially extending channel 42. The channel 42 is open along most of its length to the exterior surface 44 of the end wall and open at one of its ends to the perimeter of the end wall. As can be best seen in FIG. 5, the channel 42 is generally T-shaped in transverse cross-section such that the stem portion of the T-shape is open to the exterior surface 44 of the end wall. The channels 42 in the end walls 18 and 20 are generally parallel to one another.

Referring once again to FIGS. 1 and 3, each end wall 18 and 20 is also formed with a plurality of circumferentially spaced apart notches 46. Each of the notches 46 is formed through the circumferential flange 22 of the end walls 18, and 20 and is open to the perimeter of the end walls 18, and 20. As shown, there are four notches 46 formed in each end wall equally spaced apart circumferentially thereof.

Figure 6:
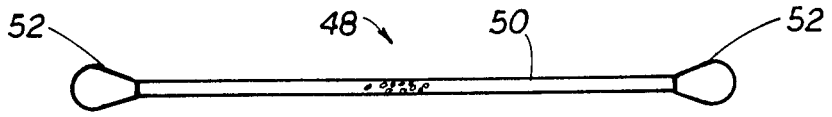
FIG. 6 is a side view of a hair curling mandrel of the present invention; and, FIG. 7 is a view of an elastic band member of the present invention.

With reference to FIG. 6, the curler of the present invention also provides a hair winding mandrel 48 which is separate from the curler housing 10. The mandrel 48 includes a slender, cylindrical rod 50 with enlarged ends 52. In addition, the mandrel rod 50 has a roughened surface to grip the hair wrapped therearound. The enlarged ends 52 of the mandrel 50 prevent the wrapped hair from slipping off either end of the mandrel 50 as well as providing a finger grasp for a person winding hair on the mandrel 50. The overall length of the mandrel 50 is less than the longitudinal length of the hollow interior of the curler housing 10 so that the mandrel 50 can be easily inserted in the curler housing 10.

Figure 7:
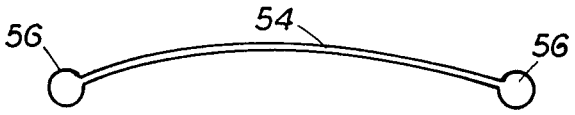

FIG. 7 depicts an elastic band member 54 of the present invention. The elastic band member 54 includes enlarged ends 56 which are adapted to being received in the T-shaped channels 42 in the circular end walls 18 and 20 of the second semi-cylindrical section 14 as shown in FIG. 5. The enlarged ends 56 of the elastic band member 54 can be of virtually and convenient construction such as, for example, a head know tie in the elastic band itself.

In operation, hair is divided into manageable sections, and the portion of the hair section near the end thereof is wound on the slender rod 50 of the hair winding mandrel 48 until the length of hair left untreated is would on the mandrel 48. The enlarged ends 52 of the mandrel 48 facilitate this procedure by allowing a person to grip one of the enlarged mandrel ends 52 between the index finger and thumb. The mandrel 48 is then placed lengthwise in the open curler housing 20 and the curler housing 10 is closed by moving the first and second semi-cylindrical sections 12 and 14 together about the hinge 16 and into facing concave relationship whereupon the protuberances 34 of the first semi-cylindrical section 12 engage the cavities 36 in the end walls 18 and 20 of the second semi-cylindrical section 14 latching the semi-cylindrical sections together in the closed position. Thus, the hair to be untreated is enclosed within the curler housing 10 with the hair to be treated extending beyond the curler housing 10 between the longitudinal lip 24 of the first semi-cylindrical section 12 and free longitudinal edge 26 of the second section 14. Because the resilient lip 24 of the first semi-cylindrical section 12 exerts a radial force toward the free longitudinal edge of the second semi-cylindrical section 14, and the opposite ends 28 of the first semi-cylindrical section 12 sealingly abut the interior surfaces of the second semi-cylindrical section end walls 18 and 20, the hair wound on the mandrel 48 is sealed in the hollow interior of the curler housing 10. The portion of the hair to be treated is wound about the exterior convex surface of the curler housing, and the curler housing is held in place by means of the elastic band. Toward this end, one enlarged end 56 of the elastic band 54 is inserted into the channel 42 of one circular end wall 18 through its open end with the band 54 extending outside the channel 42 through the portion of the channel which is open to the exterior surface 44 of the end wall 18. The elastic band 54 is routed through a convenient one of the open notches 46 in the flange section 22 of the end wall 18 and over the hair wound on the convex surface of the curler housing 10. The other end of the elastic band 54 is routed through a convenient one of the open notches 46 in the flange section 22 of the opposite end wall 20, and the enlarged end 56 thereof is inserted into the channel 42 of the circular end wall 20 through its open end such that the band 54 extends through the portion of the channel which is open to the exterior surface 444 of the end wall 20. Thus, the length of the elastic band 54 extending generally longitudinally of the hair curler housing 10 between the end walls 18 and 20 of the second semi-cylindrical section 14 holds the curler housing 10 in place with the hair to be treated wound about the exterior surface of the curler housing.

After the hair is treated, the elastic band 54 is removed by merely removing one of the enlarged band ends 56 from the end wall channel 42 in which it is seated, unwinding the newly treated hair from about the exterior surface of the curler housing 10, and opening the curler housing 10 by pressing against a finger abutment flange 40 on the first semi-cylindrical section 12 with the thumb until the protuberances 34 disengage from the cavities 36 of the end walls 18 and 20. The semi-cylindrical sections 12 and 14 are moved about the hinge 16 so that the hair winding mandrel 48 with the untreated hair wound thereon can be easily removed from the curler housing.

The foregoing detailed description is given primarily for clearness of understanding and no unnecessary limitations should be understood therefrom for modifications will become obvious to those skilled in the art upon reading this disclosure and may be made without departing from the spirit of the invention and scope of the appended claims.

What is claimed is:

1. A hair curler comprising:

a hollow, generally cylindrical housing having a first semi-cylindrical section and a second semi-cylindrical section, the first and second semi-cylindrical sections being closable together in registered concavely facing relationship;

hinge means interconnecting one longitudinal edge of the first semi-cylindrical section to one longitudinal edge of the second semi-cylindrical section; and, the free edge of the first semi-cylindrical section having an elongated resilient lip overlapping the free longitudinal edge of the second semi-cylindrical section with an interference fit therebetween and exerting a generally radial force against the free longitudinal edge of the second semi-cylindrical section when the first and second semi-cylindrical sections are in the closed relationship establishing a liquid tight seal therebetween.

2. A hair curler comprising:

a hollow, generally cylindrical housing having a first semi-cylindrical section and a second semi-cylindrical section, the first and second semi-cylindrical sections being closable in registered concavely facing relationship;

hinge means interconnecting one longitudinal edge of the first semi-cylindrical section to one longitudinal edge of the second semi-cylindrical section; and, the free edge of the first semi-cylindrical section having an elongated resilient lip which diminishes in thickness toward its distal end and with an arcuate inner surface having a different curvature than does the convex side of the second semi-cylindrical section, the resilient lip overlapping and exerting a generally radial force against the free longitudinal edge of the second semi-cylindrical section when the first and second semi-cylindrical sections are in the closed relationship.

3. The hair curler of claim 2, wherein the arcuate inner surface of the lip has a constant radius smaller than the radius of the first semi-cylindrical section.

4. The hair curler of claim 2, wherein the arcuate inner surface of the lip has a uniformly changing radius.

5. The hair curler of claim 4, wherein the arcuate inner surface of the lip is generally semi-eliptical.

6. The hair curler of claim 4, wherein the arcuate inner surface generally follows a convolute generated from approximately the longitudinal centerline of the first semi-cylindrical section.

7. The hair curler of claim 2, wherein the radial distance from the longitudinal centerline of the first semi-cylindrical section to the inner surface of the lip proximate the distal end of the lip is less than the radial distance from the longitudinal centerline of the second semi-cylindrical section to the convex side of the second semi-cylindrical section.

8. The hair curler of claim 7, wherein, when the two semi-cylindrical sections are in closed relationship, defining a line contact between the inner surface of the lip and convex side of the second semi-cylindrical section.

9. The hair curler of claim 2, further comprising a hair winding mandrel having an overall length less than the length of the interior of the hollow curler housing.

10. The hair curler of claim 9, wherein the hair winding mandrel comprises:

a slender generally cylindrical rod; and, an enlargement at each end of the slender rod.

11. A hair curler comprising:

a hollow, generally cylindrical housing having a first semi-cylindrical section and a second semi-cylindrical section, the first and second semi-cylindrical sections being closable in registered concavely facing relationship;

hinge means interconnecting one longitudinal edge of the first semi-cylindrical section to one longitudinal edge of the second semi-cylindrical section;

the second semi-cylindrical section comprises generally circular end walls at the opposite ends thereof;

the ends of the first semi-cylindrical section sealingly abut the interior surfaces of the circular end walls of the second semi-cylindrical end walls of the second semi-cylindrical section when the first and second semi-cylindrical sections are in the closed position; and, the free edge of the first semi-cylindrical section having an elongated resilient lip overlapping and exerting a generally radial force against the free longitudinal edge of the second semi-cylindrical section when the first and second semi-cylindrical sections are in the closed position.

12. The hair curler of claim 11 further comprising means defining at least one generally radial channel in each of the end walls, the channel being open to the exterior surface of the end wall and open to the perimeter of the end wall.

13. The hair curler of claim 12, further comprising an elastic band having ends adapted to be removable received within the channels of the end walls of the semi-cylindrical sections.

14. The hair curler of claim 13, wherein the elastic band comprises an enlargement at each end thereof, the enlargement being adapted to be received in channel of the end walls of the second semi-cylindrical section.

15. The hair curler of claim 11, wherein each of the circular end walls of the second semi-cylindrical section has a diameter greater than the diameter of the closed first and second semi-cylindrical sections thereby defining a circumferential flange.

16. The hair curler of claim 14, further comprising at least one notch formed through the circumferential flange of each end wall, each notch being open to the perimeter of the flange in which it is formed.

* * * * *